US009284953B2

(12) United States Patent
Blume

(10) Patent No.: US 9,284,953 B2
(45) Date of Patent: Mar. 15, 2016

(54) MULTIPLE PORT DISCHARGE MANIFOLD FLUID END

(71) Applicant: George H Blume, Austin, TX (US)

(72) Inventor: George H Blume, Austin, TX (US)

( * ) Notice: Subject to any disclaimer, the term of this patent is extended or adjusted under 35 U.S.C. 154(b) by 279 days.

(21) Appl. No.: 13/908,053

(22) Filed: Jun. 3, 2013

(65) Prior Publication Data

US 2014/0356201 A1 Dec. 4, 2014

Related U.S. Application Data

(60) Provisional application No. 61/656,718, filed on Jun. 7, 2012.

(51) Int. Cl.

| | |
|---|---|
| ***F04B 7/02*** | (2006.01) |
| ***F04B 7/00*** | (2006.01) |
| ***F04B 23/06*** | (2006.01) |
| ***F04B 15/02*** | (2006.01) |
| ***F04B 53/10*** | (2006.01) |
| ***F04B 53/16*** | (2006.01) |

(52) U.S. Cl.

CPC ..... *F04B 7/0023* (2013.01); *F04B 15/02* (2013.01); *F04B 23/06* (2013.01); *F04B 53/10* (2013.01); *F04B 53/16* (2013.01)

(58) Field of Classification Search

CPC ..... F04B 7/02; F04B 7/0233; F04B 9/109; F04B 15/04; F04B 23/06; F04B 15/02; F04B 53/10

USPC ..... 417/62, 454, 504, 533, 568; 137/266, 137/565.33, 625.28, 625.3, 625.33, 625.37, 137/561 A; D15/7

See application file for complete search history.

(56) References Cited

U.S. PATENT DOCUMENTS

| | | | | |
|---|---|---|---|---|
| 5,061,159 | A * | 10/1991 | Pryor | 417/554 |
| 2012/0183424 | A1 * | 7/2012 | Bayyouk et al. | 417/451 |

* cited by examiner

*Primary Examiner* — Devon Kramer
*Assistant Examiner* — Chirag Jariwala

(57) ABSTRACT

A fluid end assembly comprising a fluid end housing with multiple discharge manifold ports which provide a fluid end assembly that overcomes problems associated with prior art single port discharge manifold designs that result in non-symmetrical flow of discharged fluids through the fluid end discharge valves, resulting in premature failure of said valves. The multiple port discharge manifolds overcome problems associated with non-symmetrical flow of discharged fluids through a fluid end discharge valve, thereby improving valve life and performance.

18 Claims, 19 Drawing Sheets

Detail "B-B" of Figure 6A

Section "B-B" of Figure 12A

Section "C-C" of Figure 12A

Section "D-D" of Figure 12A

MULTIPLE PORT DISCHARGE MANIFOLD FLUID END

PRIORITY DATA

This patent application claims priority to U.S. Provisional Patent Application Ser. No. 61/656,718 filed on Jun. 7, 2012. By this reference, the aforementioned provisional patent application is incorporated herein for all purposes.

FIELD OF THE INVENTION

The invention generally concerns high-pressure plunger-type pumps useful, for example, in oil well hydraulic fracturing. More specifically, the invention relates to fluid end discharge manifolds suitable pumping abrasive fluids, such as sand slurries at high pressures.

BACKGROUND OF THE INVENTION

Engineers typically design high-pressure oil field plunger pumps in two sections; the (proximal) power section and the (distal) fluid section. The power section usually comprises a crankshaft, reduction gears, bearings, connecting rods, crossheads, crosshead extension rods, etc. The power section is commonly referred to as the power end by the users and hereafter in this application. The fluid section is commonly referred to as the fluid end by the users and hereafter in this application. Commonly used fluid sections usually comprise a plunger pump housing having a suction valve in a suction bore, a discharge valve in a discharge bore, an access bore, and a plunger in a plunger bore, plus high-pressure seals, retainers, etc. FIG. 1 is a cross-sectional schematic view of a typical fluid end showing its connection to a power end by stay rods. FIG. 1 also illustrates a fluid chamber which is one internal section of the housing containing the valves, seats, plungers, plunger packing, retainers, covers, and miscellaneous seals previously described. A plurality of fluid chambers similar to that illustrated in FIG. 1 may be combined, as suggested in the Triplex fluid end housing schematically illustrated in FIG. 2. It is common practice for the centerline of the plunger bore and access bore to be collinear. Typically in the prior art, the centerlines of the plunger bore, discharge bore, suction bore, and access bore are all arranged in a common plane. The spacing of the plunger bores, plungers, plunger packing, and plunger gland nut within each fluid chamber is fixed by the spacing of the crank throws and crank bearings on the crankshaft in the power end of the pump.

Engineers typically design high-pressure oil field plunger pumps with internal discharge manifolds as shown in FIGS. 1 and 2. As shown in FIG. 2, the internal discharge manifold penetrates both ends of the fluid end block, provisions are made for a pipe or line connection on both ends of the block. Typically with small plunger sizes, one end is fitted with a blind flange to seal off the end fitted with the blind flange, thus all fluid flow is directed through the opposite end of the manifold. For large plungers or fluid ends with more than three plungers, a connection is added at both ends of the manifold, thus fluid flow is in both directions. For pumps fitted with discharge lines from both ends of the manifold, the discharge fluid flow is then collected from both ends of the manifold along with discharge flow from additional pumps into a larger manifold downstream from the pump. This downstream manifold then combines all the incoming fluid flow into one outlet to direct the combined flow into the oil well.

Valve terminology varies according to the industry (e.g., pipeline or oil field service) in which the valve is used. In some applications, the term "valve" means just the valve body, which reversibly seals against the valve seat. In other applications, the term "valve" includes components in addition to the valve body, such as the valve seat and the housing that contains the valve body and valve seat. A valve as described herein comprises a valve body and a corresponding valve seat, the valve body typically incorporating an elastomeric seal within a peripheral seal retention groove.

Valves can be mounted in the fluid end of a high-pressure pump incorporating positive displacement pistons or plungers in multiple cylinders. Such valves typically experience high pressures and repetitive impact loading of the valve body and valve seat. These severe operating conditions have in the past often resulted in leakage and/or premature valve failure due to metal wear and fatigue. In overcoming such failure modes, special attention is focused on valve sealing surfaces (contact areas) where the valve body contacts the valve seat intermittently for reversibly blocking fluid flow through a valve.

Valve sealing surfaces are subject to exceptionally harsh conditions in exploring and drilling for oil and gas, as well as in their production. For example, producers often must resort to "enhanced recovery" methods to insure that an oil well is producing at a rate that is profitable. And one of the most common methods of enhancing recovery from an oil well is known as fracturing. During fracturing, cracks are created in the rock of an oil bearing formation by application of high hydraulic pressure. Immediately following fracturing, a slurry comprising sand and/or other particulate material is pumped into the cracks under high pressure so they will remain propped open after hydraulic pressure is released from the well. With the cracks thus held open, the flow of oil through the rock formation toward the well is usually increased.

The industry term for particulate material in the slurry used to prop open the cracks created by fracturing is the propend. And in cases of very high pressures within a rock formation, the propend may comprise extremely small aluminum oxide spheres instead of sand. Aluminum oxide spheres may be preferred because their spherical shape gives them higher compressive strength than angular sand grains. Such high compressive strength is needed to withstand pressures tending to close cracks that were opened by fracturing. Unfortunately, both sand and aluminum oxide slurries are very abrasive, typically causing rapid wear of many component parts in the positive displacement plunger pumps through which they flow. Accelerated wear is particularly noticeable in plunger seals and in the suction (i.e., intake) and discharge valves of these pumps.

A valve (comprising a valve body and valve seat) that is representative of an example full open design valve and seat for a fracturing plunger pump is schematically illustrated in FIG. 3. The valve of FIG. 3 is shown in the open position. For each valve, back pressure tends to close the valve when downstream pressure exceeds upstream pressure. For example, when valve is used as a suction valve, back pressure is present on the valve during the pump plunger's pressure stroke (i.e., when internal pump pressure becomes higher than the pressure of the intake slurry stream. During each pressure stroke, when the intake slurry stream is thus blocked by a closed suction valve, internal pump pressure rises and slurry is discharged from the pump through a discharge valve. For a discharge valve, back pressure tending to close the valve arises whenever downstream pressure in the slurry stream (which remains relatively high) becomes greater than internal pump pressure (which is briefly reduced each time the pump plunger is withdrawn as more slurry is sucked into the pump through the open suction valve).

Typically the motion of the valve body is controlled by valve guide legs attached to the bottom or upstream side of the valve body as shown in FIG. 3. Unfortunately these guide legs are another source of accelerated valve and seat failure when pumping high sand slurry concentrations. FIG. 4A illustrates an old style valve design, circa 1970, in which the valve legs are forged into the upstream side of the valve body; typical of a Mission Service Master I design. FIG. 4B illustrates the slurry flow patterns around the leg; as can be seen in the figure, the downstream side of the legs generates considerable turbulence in the flow. The swirling turbulence in the sand slurry used in typical fracturing work results in sever abrasion of the metal valve body and the elastomeric insert seal, which quickly damages the seal, resulting in seal failure. Once the seal fails on the valve insert, the high pressure fluid on the downstream side of the valve escapes through the seal failure to the low pressure upstream side of the valve. Travelling from the very high pressure to the very low pressure side of the valve results in extreme velocities of the sand slurry, which rapidly erodes the metal valve body and the guide legs in the slurry's path; many times destroying the entire valve leg. Engineers typically recognize the beginning of this failure by four (4) erosion marks behind each leg on worn valves removed from the pump just prior to catastrophic failure in which one or more of the valve legs are completely destroyed by the high pressure erosion. The abraded seal and erosion of the metal valve body are also illustrated in FIG. 4B.

The development of the Roughneck valve design, circa 1983, and later the Mission Service Master II valve or the Novatech valve shown in FIG. 5A greatly improved the flow behind the legs. These designs featured streamlined legs which were achieved by inertia welding an investment guide leg casting to the valve body forging. The streamlined legs and the open area below the valve body and downstream of the guide legs eliminated much of the turbulence behind the guide legs. However in severe pumping environments with high pump rates and high slurry concentrations the problem described in the previous paragraph still existed as evidenced by the four (4) erosion marks and destroyed guide legs. FIG. 5B is a picture a valve of the prior art damaged by seal failure and severe erosion behind the guide legs.

The most obvious solution to the problem described above is the removal of the guide legs and somehow guide the motion of the valve by other means. Historically many attempts have been made utilizing top stem valves, illustrated in FIGS. 6A and 6B. FIG. 6A illustrates a cross section of a fluid end showing the fluid chamber, the suction fluid chamber and the discharge fluid chamber illustrated in FIG. 6B. However top stem design valves are inherently unstable in the open position, particularly the discharge valve in the discharge fluid chamber. Once pushed off center by hydraulic flow as illustrated in FIG. 7, the forces on the discharge valve tend to push the valve further off center. As the valve continues its cyclic repeating opening and closing, the sliding forces cause rapid and accelerating wear on the top stem guide.

FIG. 6B is a partial cross-section schematically illustrating fluid chamber of FIG. 6A in its closed position (i.e., with peripheral elastomeric seal held in symmetrical contact with valve seat by discharge valve spring). Note that top guide stem of discharge valve body is aligned in close sliding contact with top valve stem guide.

FIG. 8 schematically illustrates how misalignment of top guide stem is possible with excessive wear of top valve stem guide. Such excessive wear can occur because discharge valve body, including top guide stem, is typically made of steel that has been carburized to a hardness of about 60 Rockwell C. In contrast, the female guide for the top stem discharge valve, which is shown in FIG. 6B, is usually integral within discharge cover, is typically made of mild alloy steel with a hardness of about 30 Rockwell C. Thus the softer wall of the stem guide is worn away by sliding contact with the harder guide stem. This wear is accelerated by side loads on valve body that result when fluid flowing past the valve body changes its direction of flow into the discharge manifold. Eventually, top valve stem guide can be worn sufficiently to allow discharge valve leakage due to significant asymmetric contact of elastomeric seal with valve seat as schematically illustrated in FIG. 8.

The change of direction of the fluid and the generated side loads is most severe for the discharge valve where the fluid must make a 90 degree change of direction into the discharge manifold immediately after the fluid exits the seat as shown by the heavy dashed lines in FIG. 7. Because the fluid must take the most direct path and the path with least obstructions, most of the fluid flows through one side of the valve as shown in FIG. 8.

The problem of stem guide wear is typically addressed in practice through use of a replaceable bushing having a modified top valve stem guide (see the schematic illustration in FIG. 9). Bushing is commonly made of a plastic such as urethane, or a wear and corrosion-resistant metal such as bronze. Such bushings require periodic checking and replacement, but these steps may be overlooked by pump mechanics until a valve fails prematurely.

When the open valve is badly misaligned and the valve guide is badly worn there are not aligning forces available to properly align the valve as it closes. Thus the valve will close against the seat in a miss-aligned or cocked position as shown in FIG. 8. In this position, the cocked valve leaves an extrusion gap that results in shorten valve insert seal life. The cocked valve also results in uneven loading of the metal valve body against the seating surface of the seat resulting in accelerated metal wear on the valve body and seat.

SUMMARY OF THE INVENTION

The present invention addresses the problem of instability in top stem guided valves due to non-symmetrical flow around the discharge valve which shortens valve life. The present invention restores symmetrical flow around the discharge valve by utilizing a multiple port discharge manifold.

In a representative embodiment of the disclosure, a positive displacement pump fluid end comprises at least one discharge fluid chamber, and the discharge fluid chamber further comprises a plunger bore, a discharge valve seat, a discharge valve; a suction fluid chamber and at least two discharge manifold ports on opposite sides of said fluid chamber. Fluid is discharged through the discharge seat by the forward stroke of a plunger in said plunger bore, and the flow of said discharged fluid is diverted around said discharge valve in a substantially uniform flow pattern to exit said fluid end through said at least two discharge manifold ports. At least one embodiment discloses the discharge fluid chamber being offset from the suction fluid chamber to increase the wall thickness around the discharge manifold connection on the side of the fluid end.

A representative fluid end housing comprising a dual port discharge manifold in accordance with embodiments of the invention is illustrated in FIGS. 10, 11, 12A, 12B, 12C, 12D and 13. Said dual port manifold connects adjacent discharge fluid chambers to channel discharge flow from the fluid end to one or more connections on the side of the fluid end. FIG. 11 illustrates how the dual port manifold restores symmetrical flow around the valve to increase valve performance. Symmetrical flow eliminates the forces that cause valve cocking and miss-alignment that shortens valve life. All plungers in the fluid end are arranged in a common plane defined by the crankshaft and crossheads in the power end of the pump. Various embodiments of the disclosure show different connections from the discharge manifold on each side of the fluid end housing.

Because the fluid chamber around the suction valve, is basically cylindrical, there is no change of direction in fluid flow immediately above the suction valve; flow through the valve and seat remains symmetrical, thus there is very little cocking or miss-alignment of the suction valve. In the area well above the suction valve, the fluid changes direction to enter the plunger bore, however this area is of such distance from the suction valve that the change of direction in the fluid flow does not affect the flow through the suction valve.

DETAILED DESCRIPTION

Figure 1:
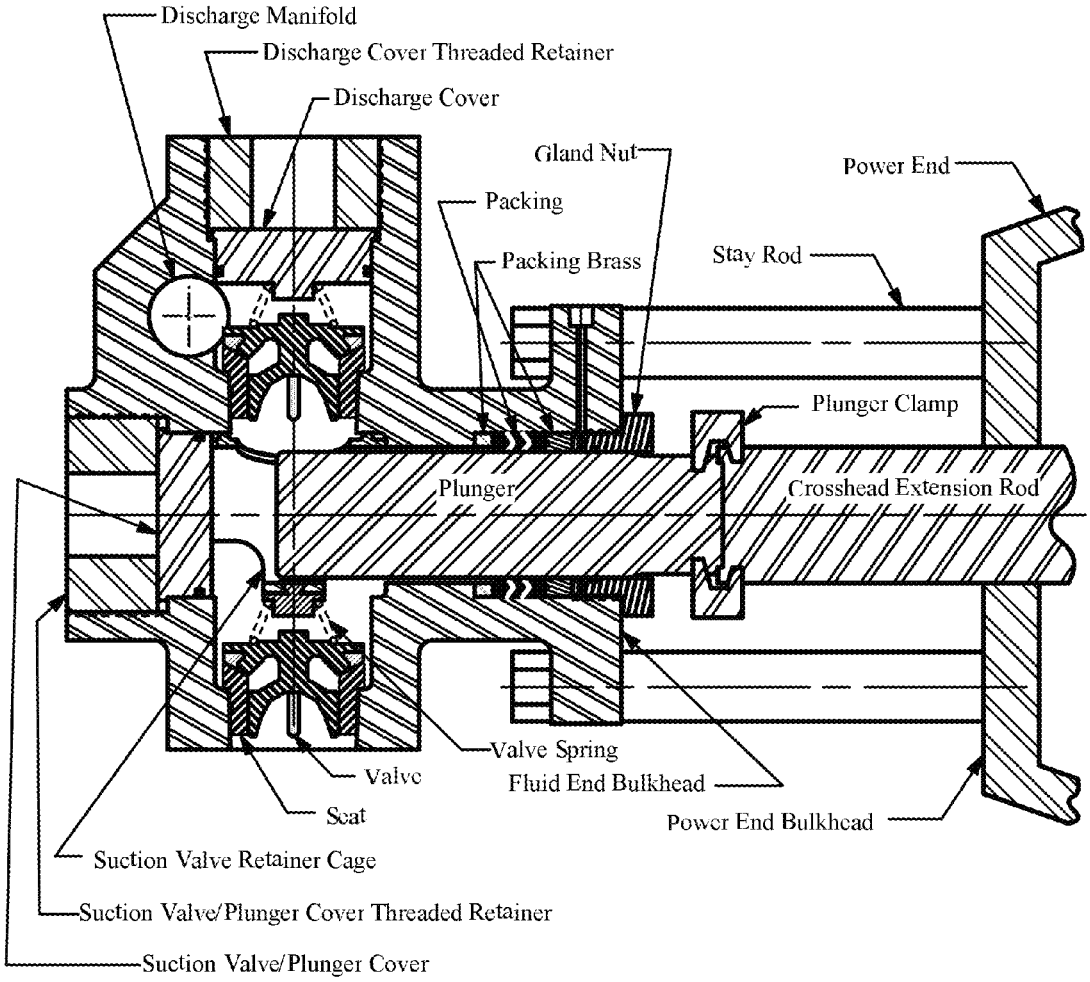
FIG. 1 is a cross-sectional schematic view of a typical plunger pump fluid section showing its connection to a power section by stay rods.
Figure 2:
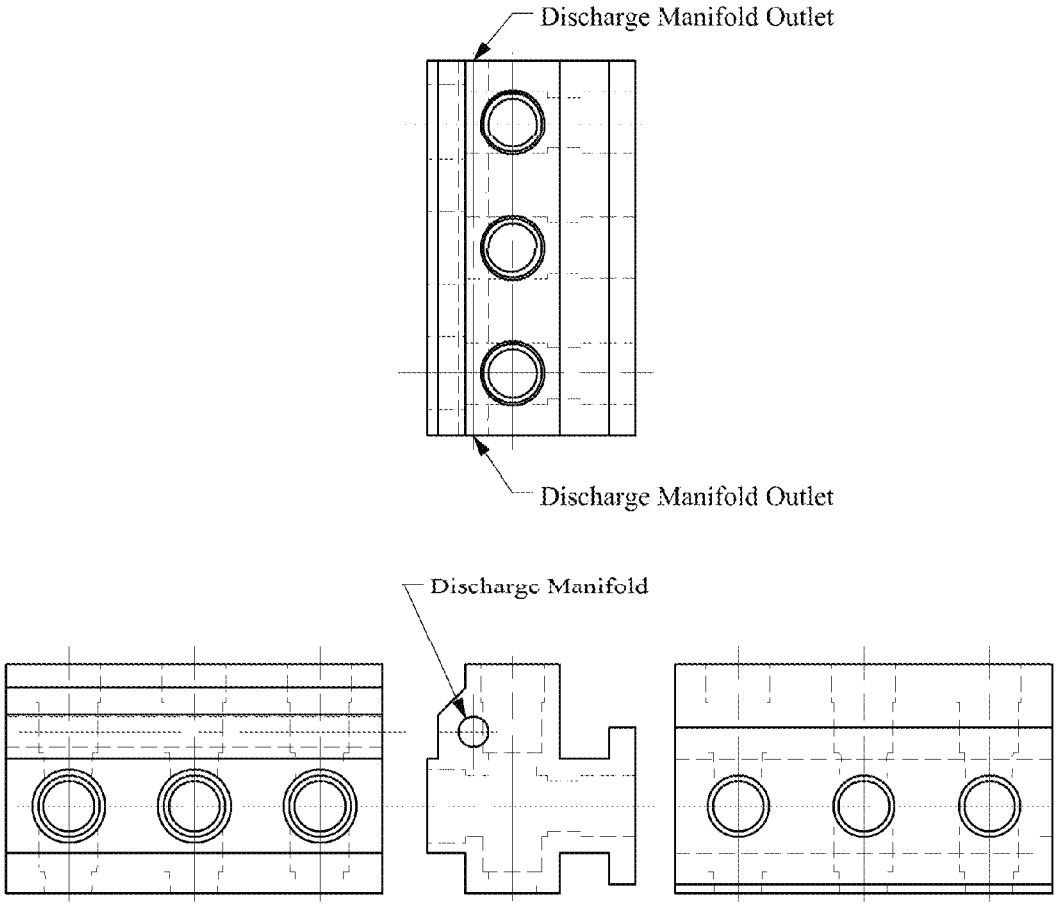
FIG. 2 schematically illustrates a conventional Triplex plunger pump fluid section housing.
Figure 3:
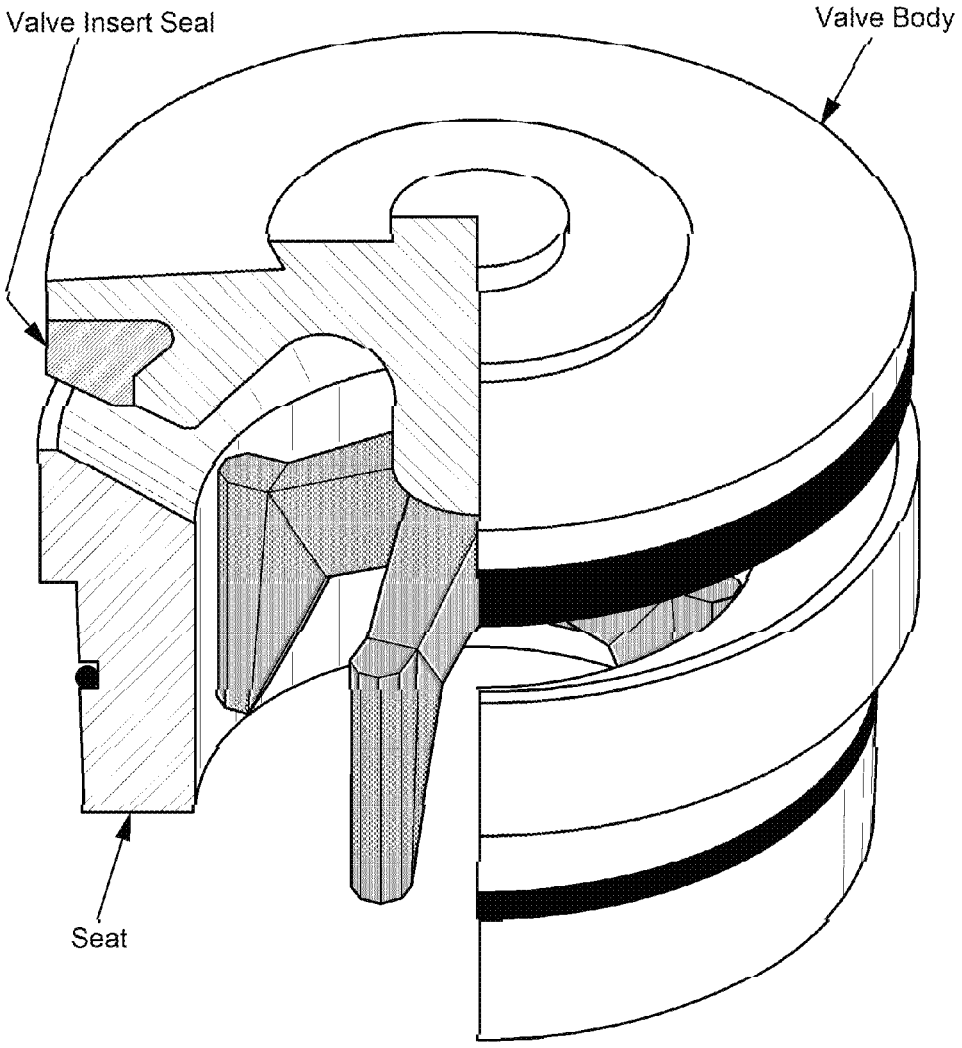
FIG. 3 schematically illustrates a cross-section of a typical high-pressure pump valve comprising a valve body and a corresponding valve seat.
Figure 4A:
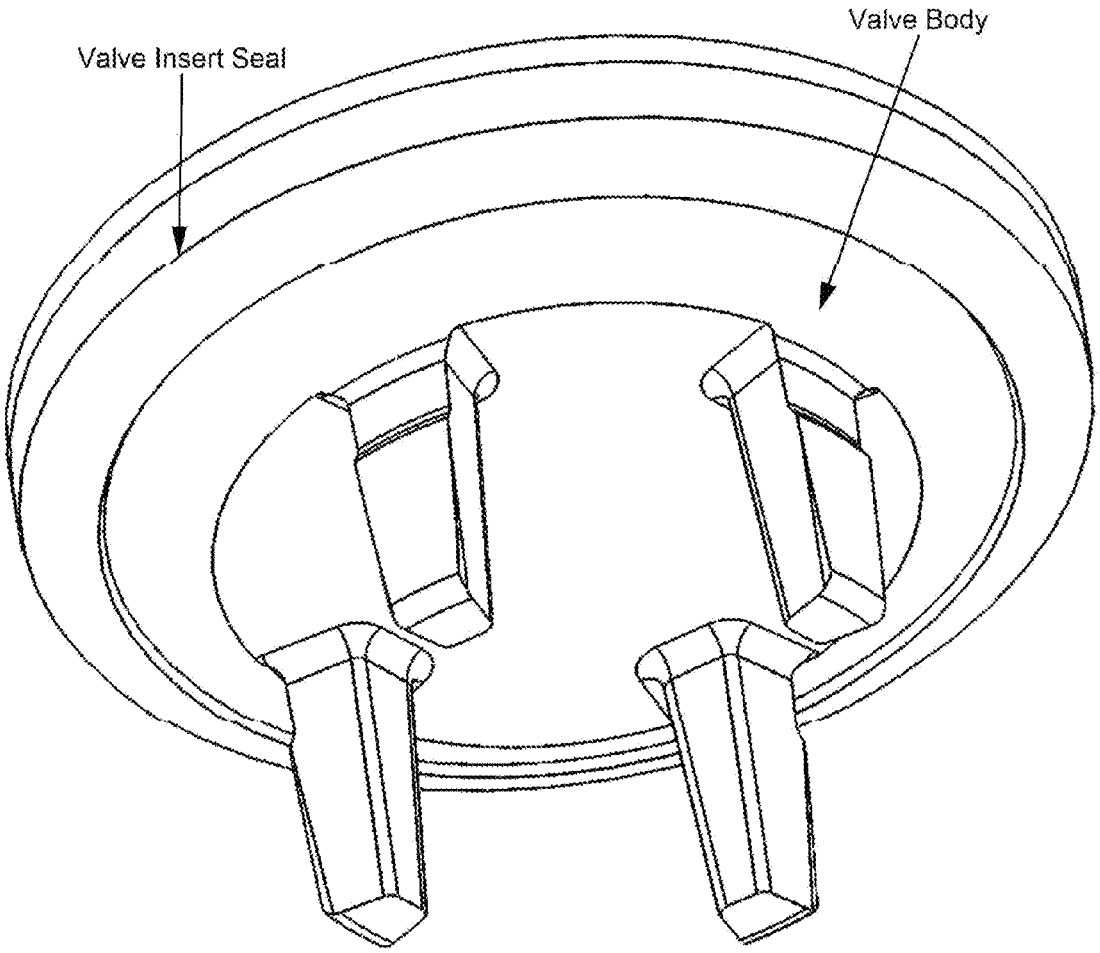
FIG. 4A schematically illustrates a valve body design in which the legs are forged into the main valve body.
Figure 4B:
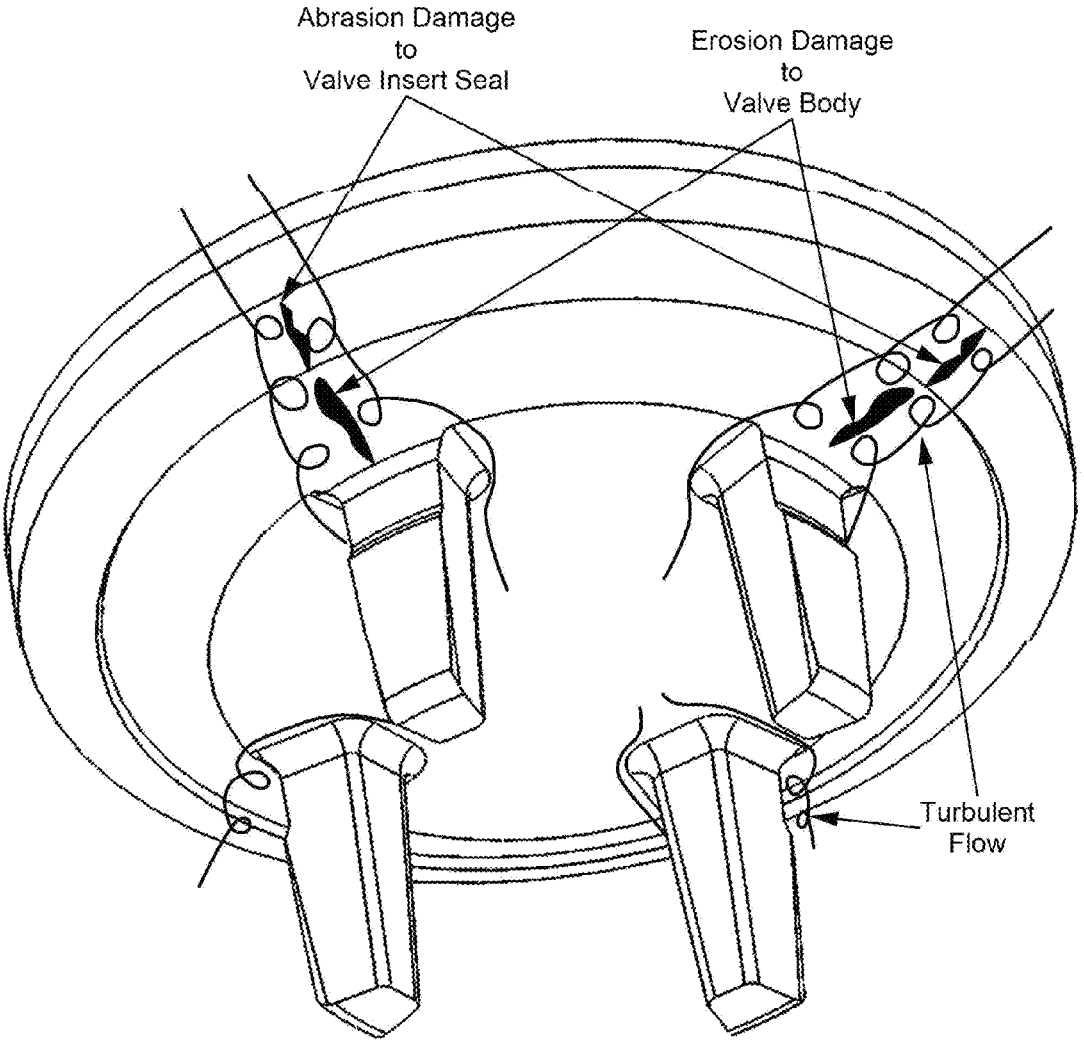
FIG. 4B schematically illustrates the valve of FIG. 4A and the flow turbulence around the guide legs.
Figure 5A:
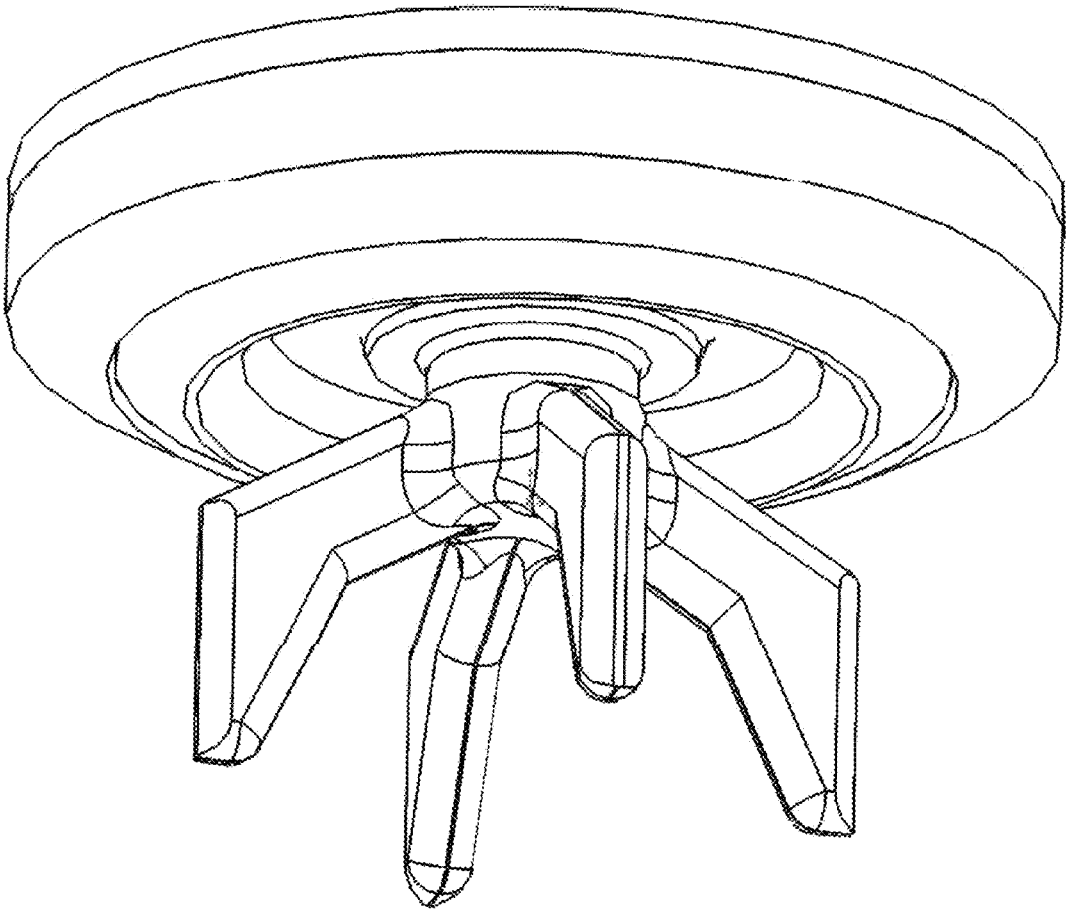
FIG. 5A schematically illustrates a current state of the art valve design in which the guide legs are a streamlined investment casting to provide improved fluid flow.
Figure 5B:
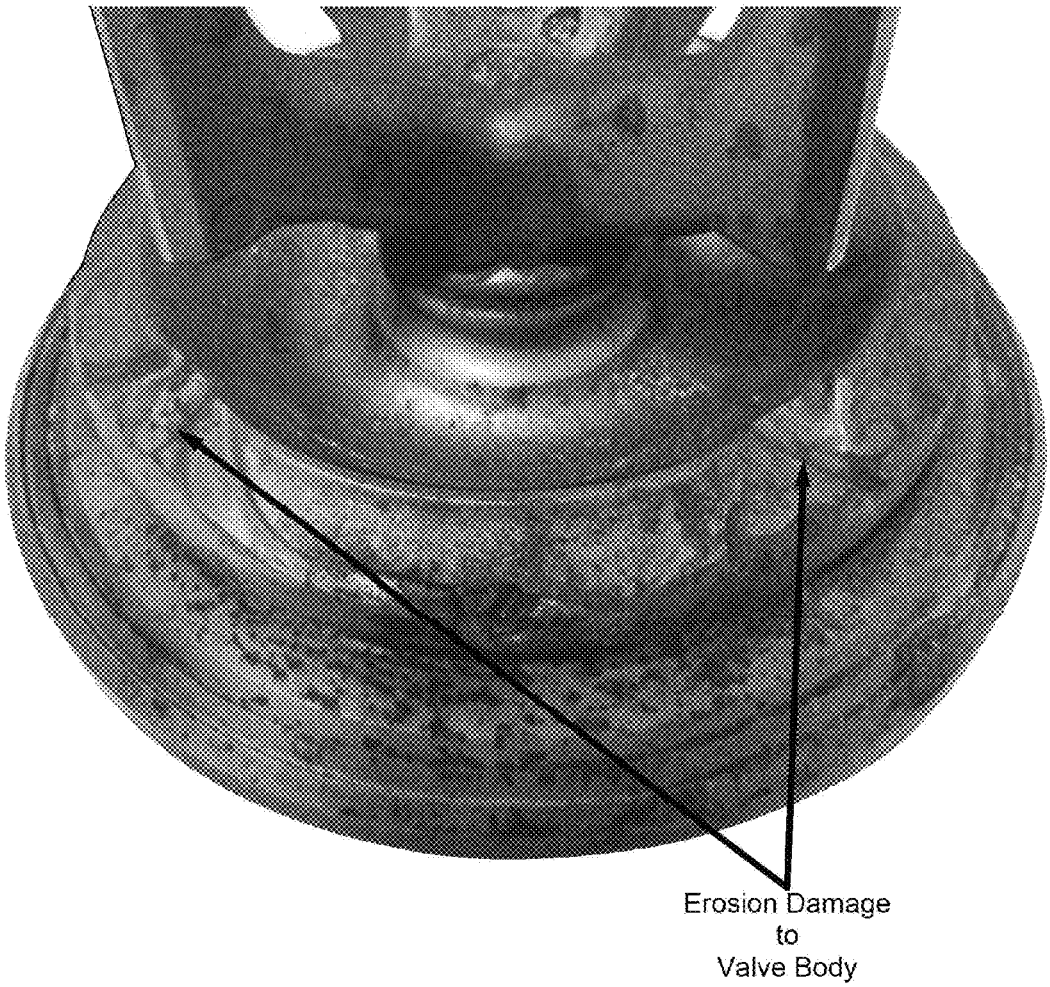
FIG. 5B is a picture of an actual valve of a design schematically illustrated in FIG. 5A and the erosion damage due to turbulent fluid flow.
Figure 6A:
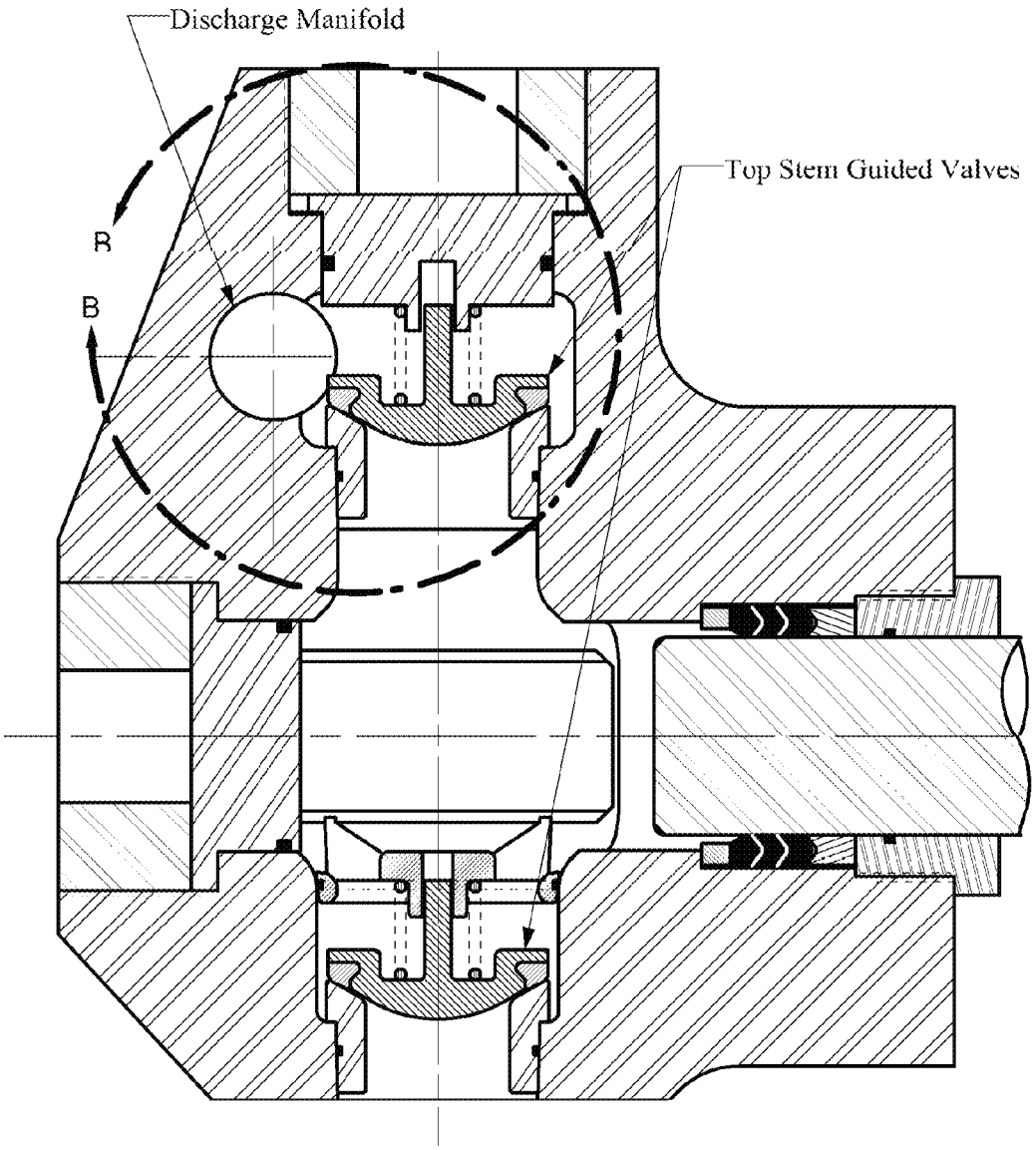
FIG. 6A schematically illustrates a cross-section of a right-angular plunger pump having a top stem guided suction valve and a top stem guided discharge valve.
Figure 6B:
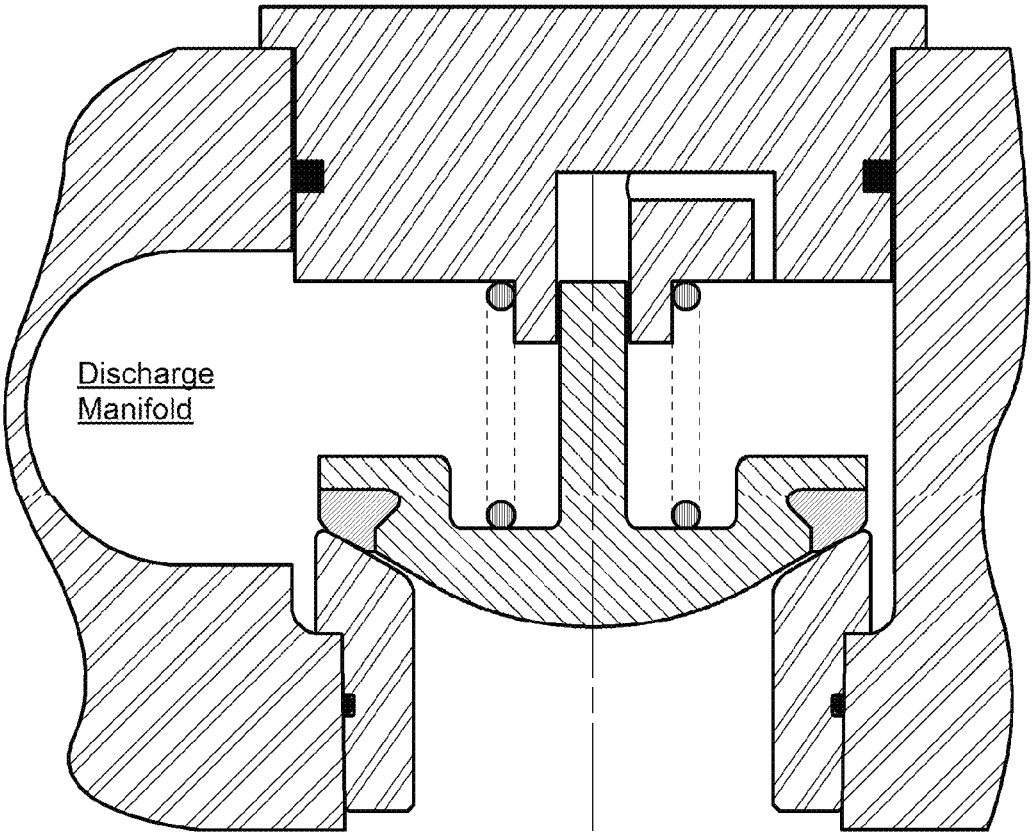
FIG. 6B is a partial cross-section schematically illustrating detail "B-B" of FIGS. 6A.
Figure 7:
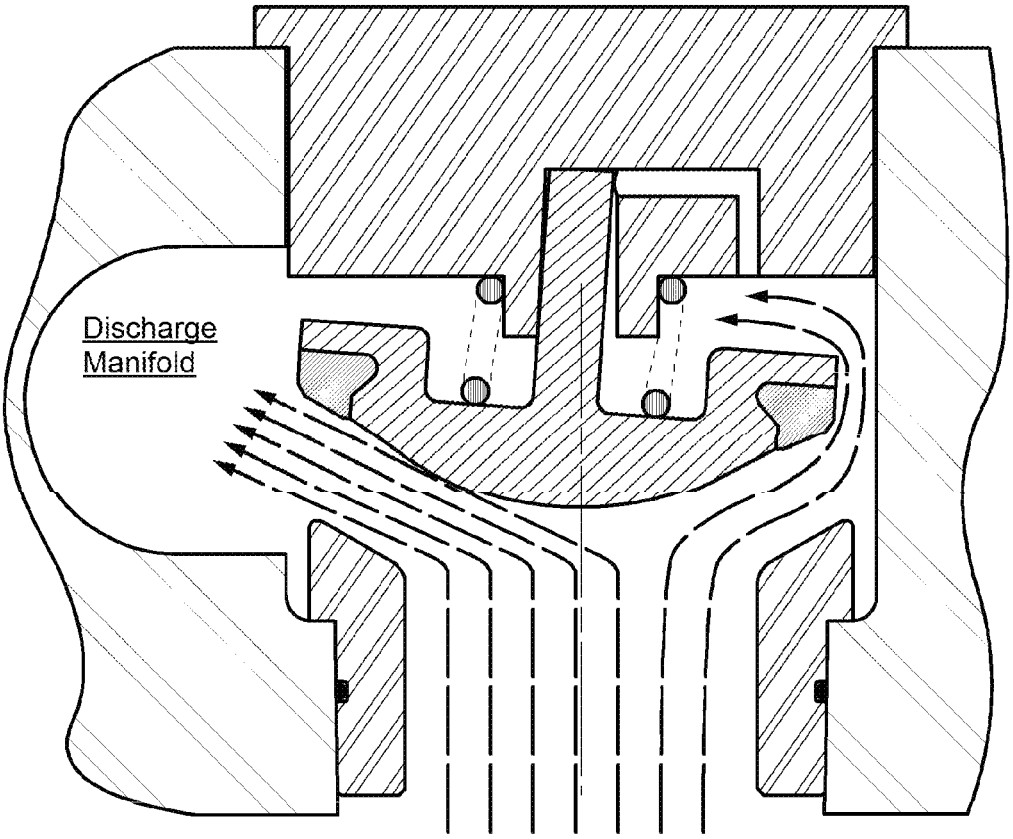
FIG. 7 schematically illustrates the flow around the discharge valve body of FIGS. 6A and 6B; valve in the open position.
Figure 8:
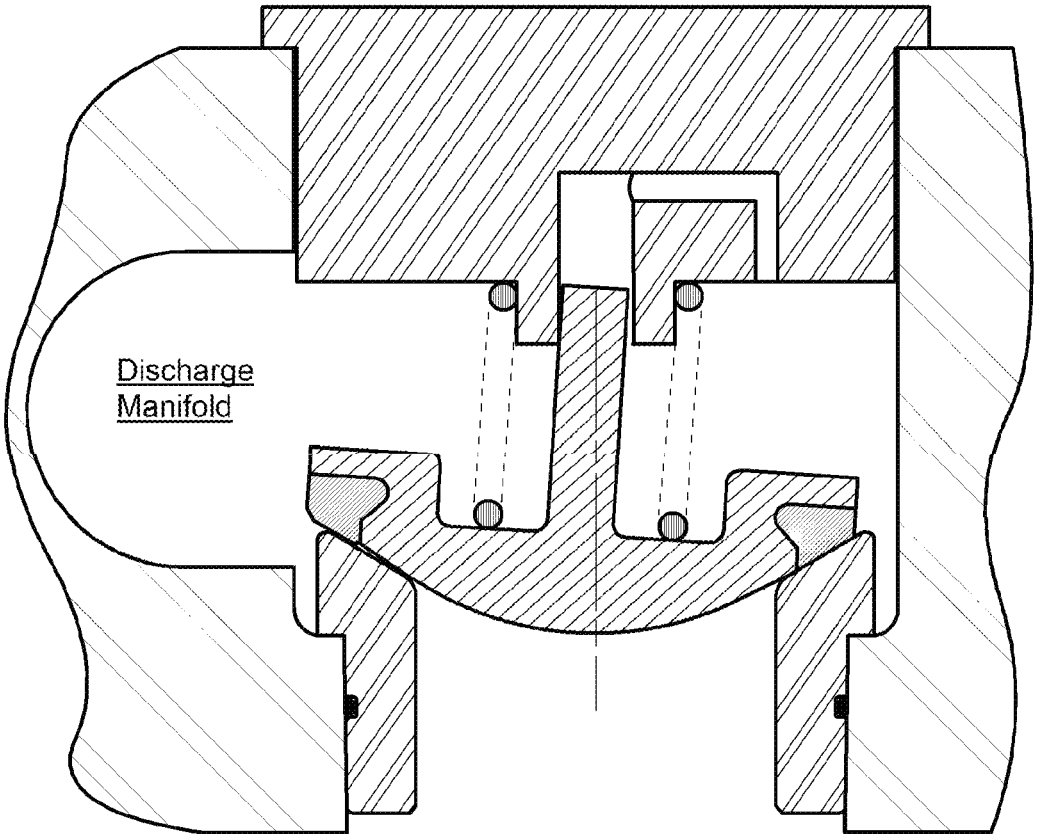
FIG. 8 schematically illustrates improper closure of the discharge valve of FIGS. 6A and 6B due to misalignment of the top guide stem.
Figure 9:
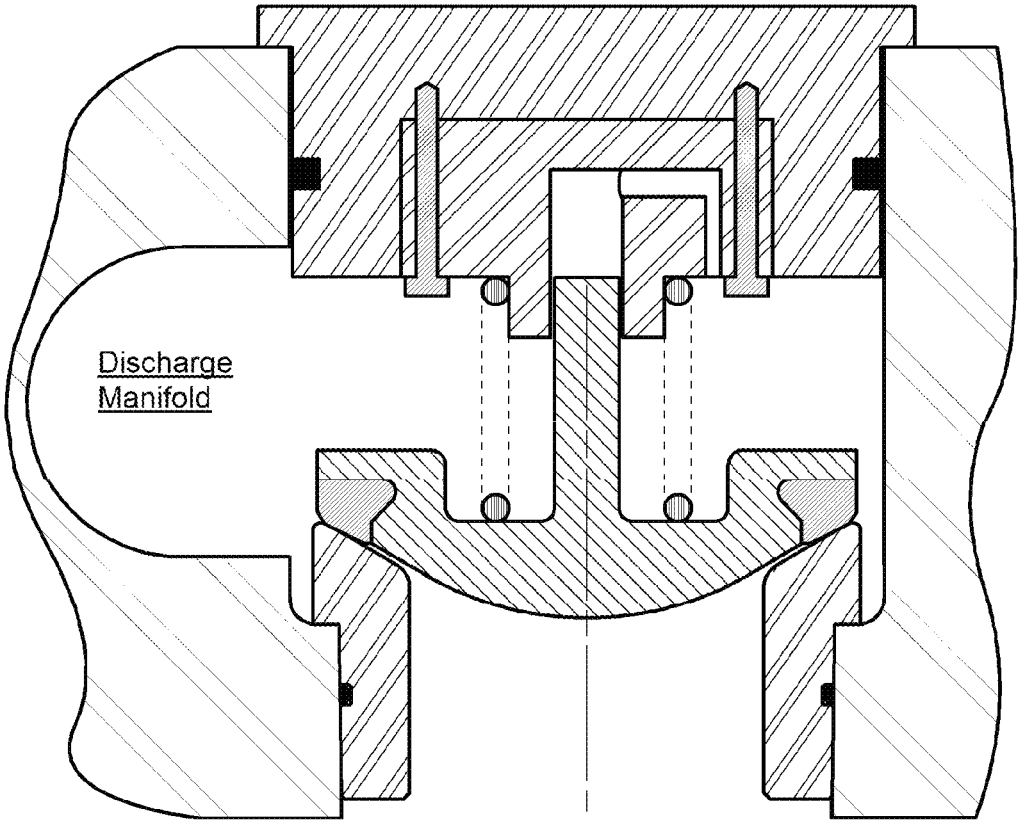
FIG. 9 schematically illustrates a replaceable bushing in a modification of the top valve stem guide shown in FIG. 7.
Figure 10:
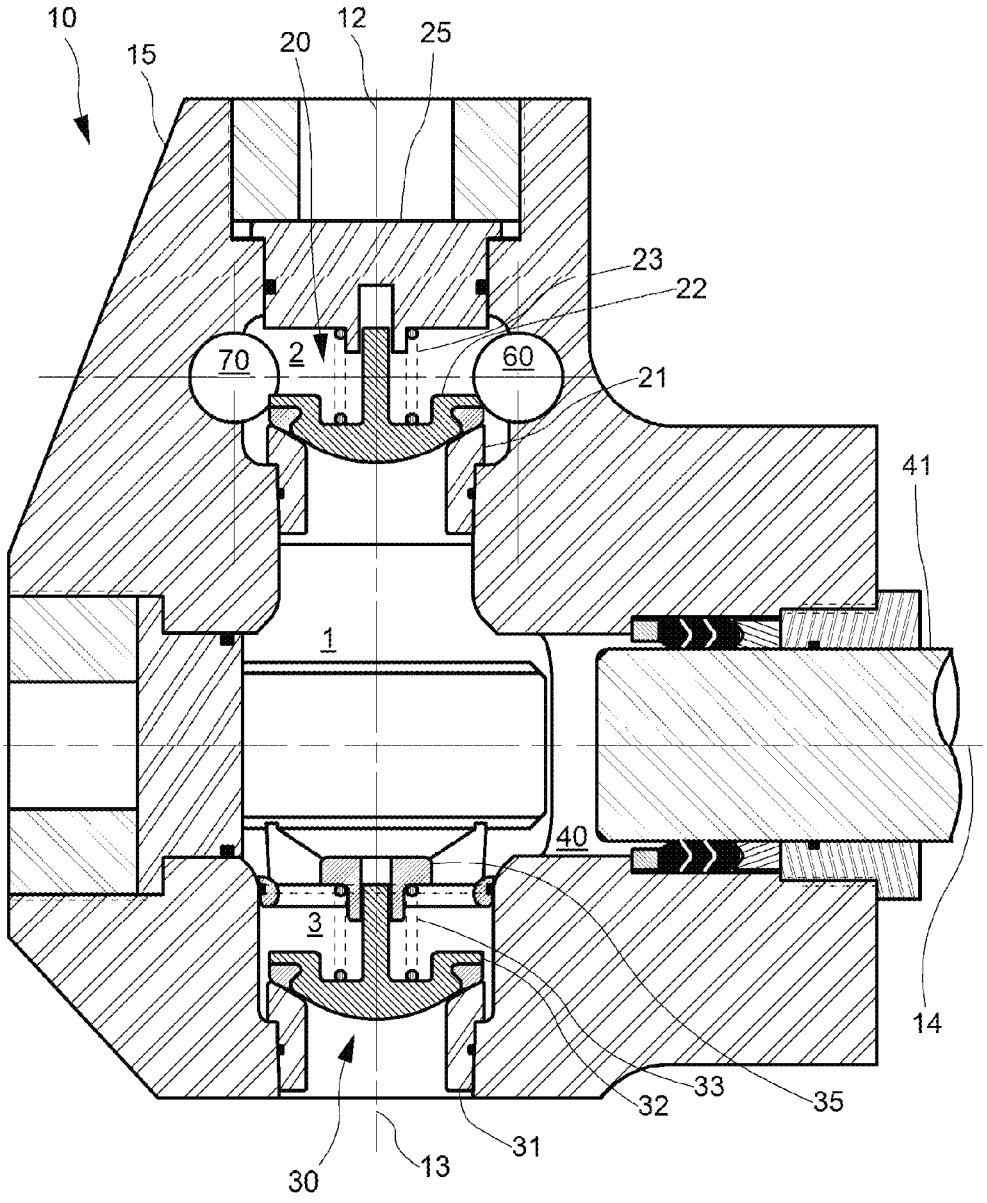
FIG. 10 schematically illustrates an embodiment of a fluid end assembly with top-stem-guided valves and a dual port discharge manifold made according to the present invention.
Figure 11:
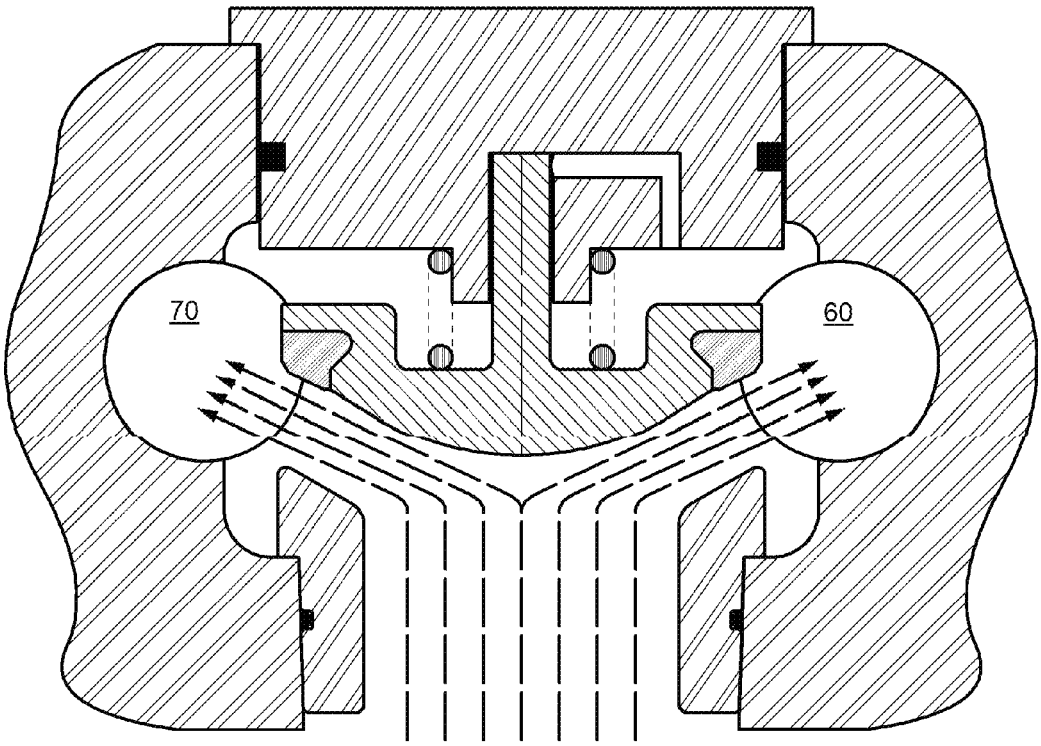
FIG. 11 schematically illustrates the discharge valve in the open position and the symmetrical fluid flow around the discharge valve in the discharge fluid chamber of the fluid end of FIG. 10.

FIG. 10 schematically illustrates a cross-section of a right-angular plunger pump fluid end 10 of the present invention. Fluid end assembly composes a fluid end housing 15 with a central fluid chamber 1 which has a discharge fluid chamber 2 and a suction chamber 3, wherein discharge fluid chamber 2 contains a discharge valve and seat assembly 20. Said discharge valve and seat assembly includes discharge seat 21, discharge valve 22, discharge spring 23, and discharge cover guide 25. Similarly suction fluid chamber 3 contains a suction valve and seat assembly 30 composed of suction seat 31, suction valve 32, suction spring 33, and suction spring retainer guide 35. Discharge chamber 2 centerline 12 is collinear with suction chamber centerline 13 in the first embodiment. Central fluid chamber 1 also contains a plunger bore 40 and associated plunger 41; plunger bore 40 and plunger 41 are concentric to plunger centerline 14.

Additionally FIG. 10 illustrates discharge fluid chamber 2 which is connected to adjacent discharge fluid chambers 102, 202 and any additional fluid chambers by dual port discharge manifolds 60 and 70 spaced on opposite sides of fluid chamber 2. Discharge manifold 60 is proximal to the pump power end and discharge manifold 70 is distal to the pump power end. Adjacent discharge fluid chambers 102 and 202 are illustrated in FIGS. 12B, 12C, and 12D. Centerlines of dual port discharge manifolds 60 and 70 are perpendicular to the axis of the plunger bore 40 and parallel to the plane formed by the respective centerlines of all the plungers in fluid end 10.

Figure 12A:
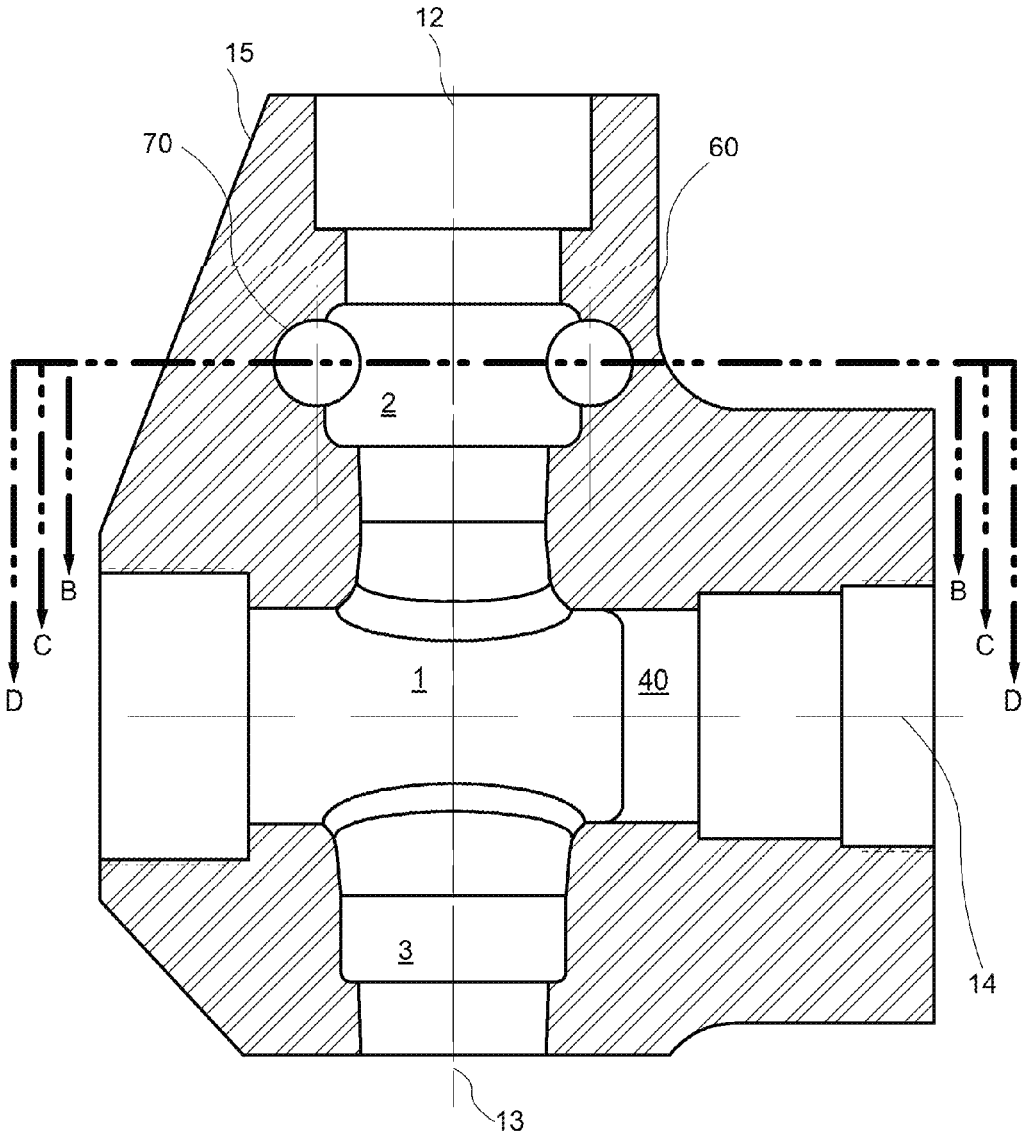
FIG. 12A schematically illustrates a cross-section of a right-angular fluid end housing of FIG. 10.
Figure 12B:
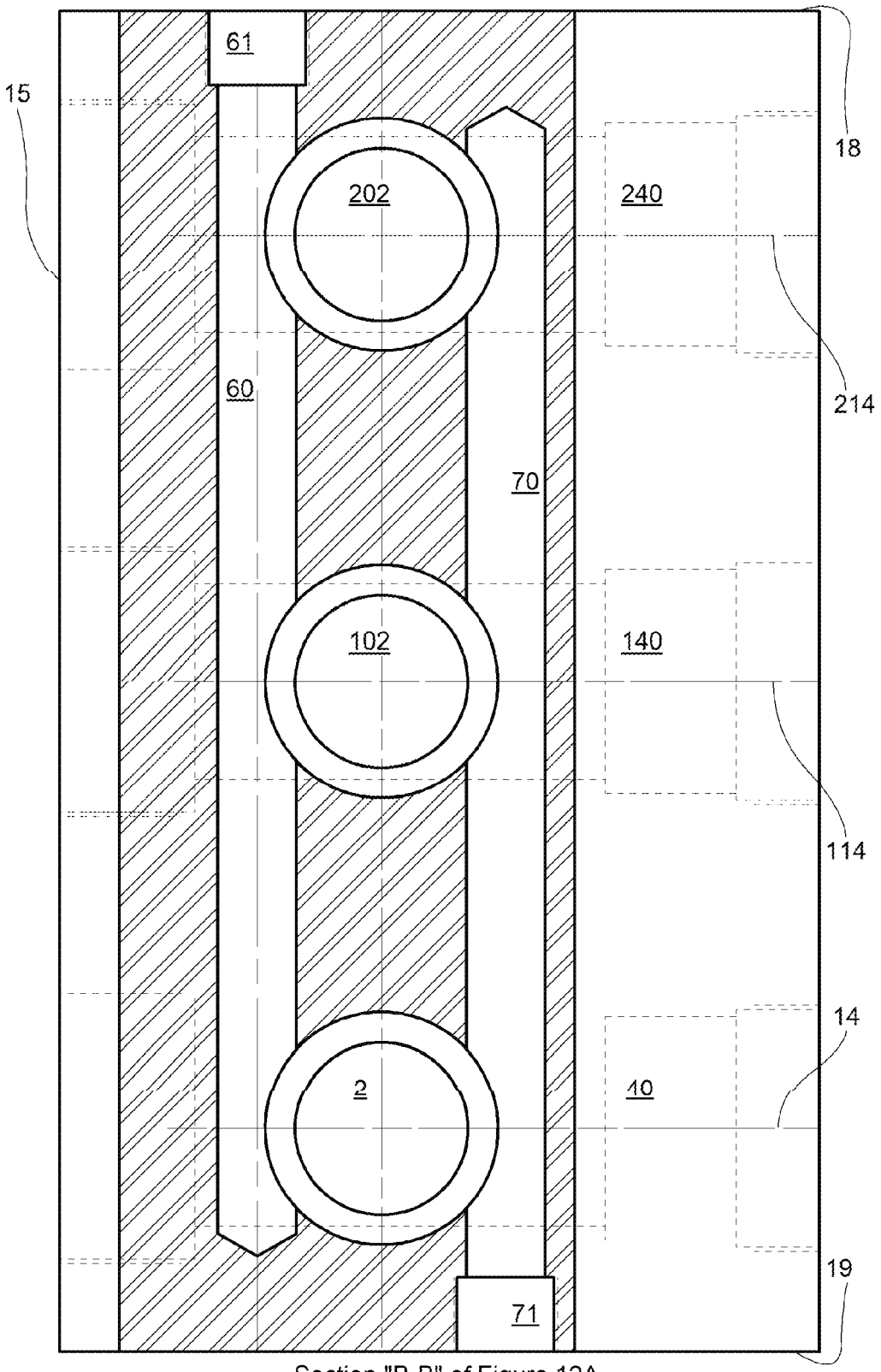
FIG. 12B schematically illustrates the sectional view labeled B-B in FIG. 12A.
Figure 12C:
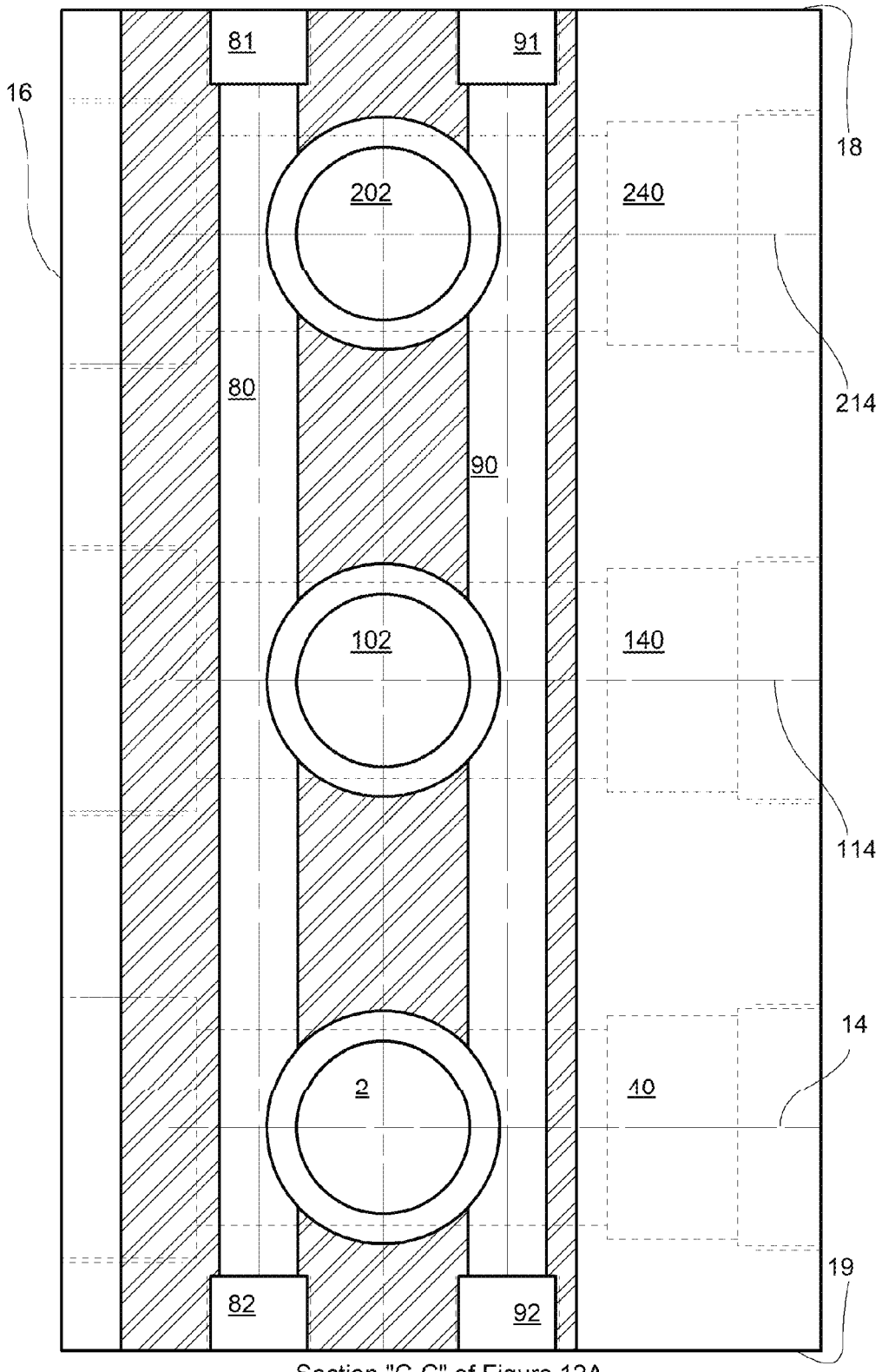
FIG. 12C schematically illustrates an alternate embodiment shown as the sectional view labeled C-C in FIG. 12A.
Figure 12D:
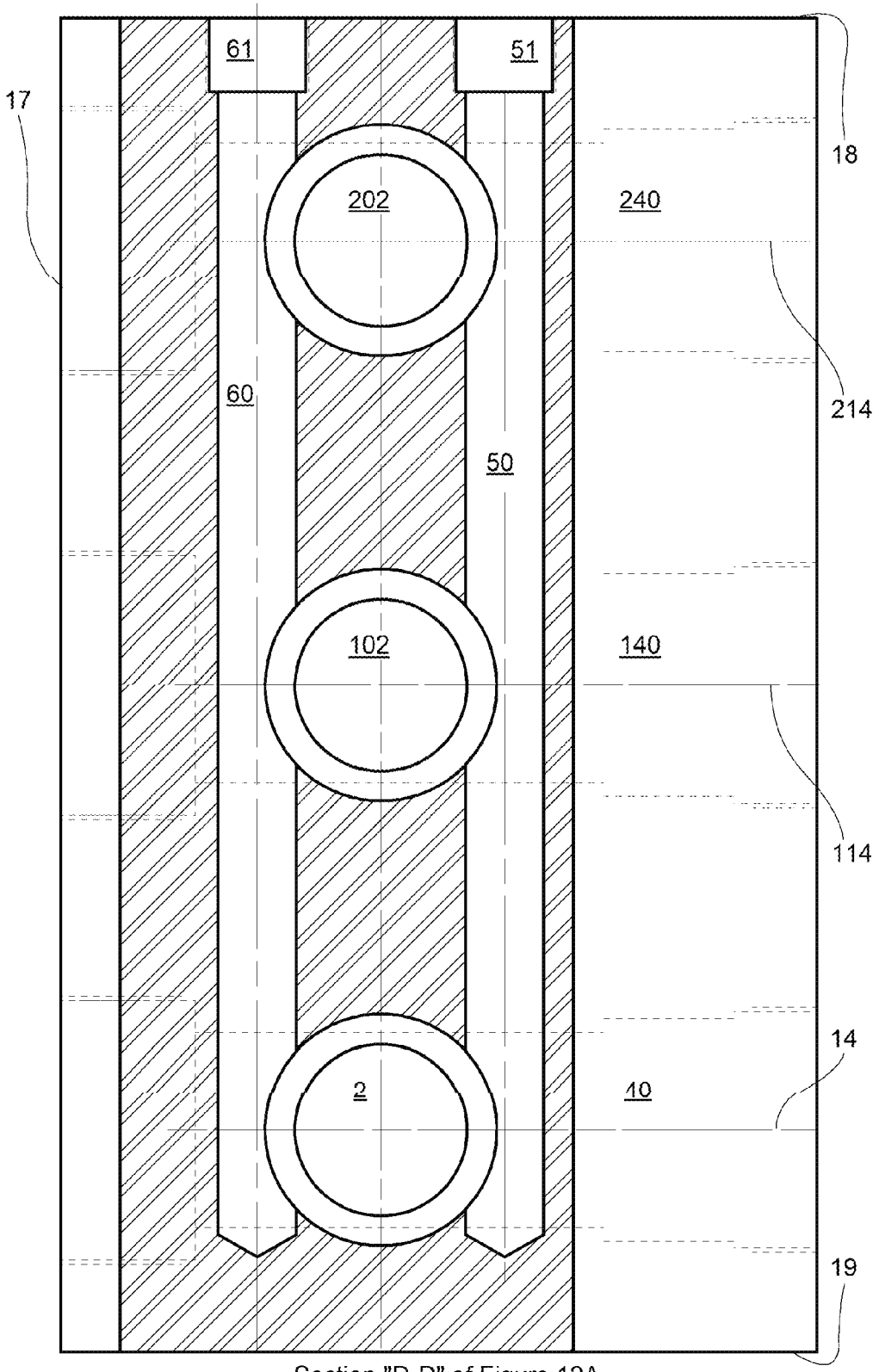
FIG. 12D schematically illustrates an alternate embodiment shown as the sectional view labeled D-D in FIG. 12A.

FIG. 12A schematically illustrates cross sectional view of fluid end housing 15 of fluid end assembly 10 of FIG. 10. Fluid end housing 15 comprises distal discharge manifold port 70, proximal discharge manifold port 60, central fluid chamber 1, discharge fluid chamber 2, suction fluid chamber 3, and plunger bore 40, defined by plunger bore centerline 14.

FIGS. 12B, 12C, and 12D illustrate discharge fluid chambers 2, 102, and 202 and adjacent plunger bores 40, 140, and 240 respectfully of a multi-plunger pump arranged in a plane defined by plunger bore centerlines 14, 114, and 214 respectfully. Said plane is collinear with the plane defined by the pump power end crankshaft and crossheads. Said adjacent plunger bores contain adjacent plungers 141 and 242 (not shown.)

FIG. 12B schematically illustrates top sectional view of first embodiment of this invention in which fluid end block 15 is fitted with a distal discharge manifold port 60 and a proximal discharge manifold port 70. Each port being blind bored from opposite sides 18 and 19 of fluid end block 15. Distal port 60 and proximal port 70 each have a connection 61 and 71 respectfully at the exit of the respective ports 60 and 70 to connect the discharge flow of the pump to external piping. Connections 61 and 71 can be a threaded type connection as shown or the connection maybe a bolt-on flange type connection, not shown. Flange connections typical have male or female WECO style union connections for connecting downstream piping.

FIG. 12C schematically illustrates top sectional view a second embodiment of this invention in which fluid end block 16 is fitted with a distal port 80 and a proximal port 90. Each port being through bored into fluid end block 16. Distal port 80 has dual connections 81 and 82 on opposite sides 18 and 19 of fluid end housing to connect the discharge flow to external piping. Similarly proximal port 90 has dual connections 91 and 92 on opposite sides 18 and 19 of fluid end housing to connect the discharge flow to external piping.

FIG. 12D schematically illustrates top sectional view of third embodiment of this invention in which fluid end block 17 is fitted with a distal port 60 and a proximal port 50. Each port being blind bored from the same side of fluid end block 17; either side 18 or 19. Illustrated in this figure, distal port 60 and proximal port 50 each have a connection 61 and 51 respectfully on side 18 of the fluid end housing 17 at the exit of the respective ports 60 and 50 to connect the discharge flow to external piping.

Figure 13:
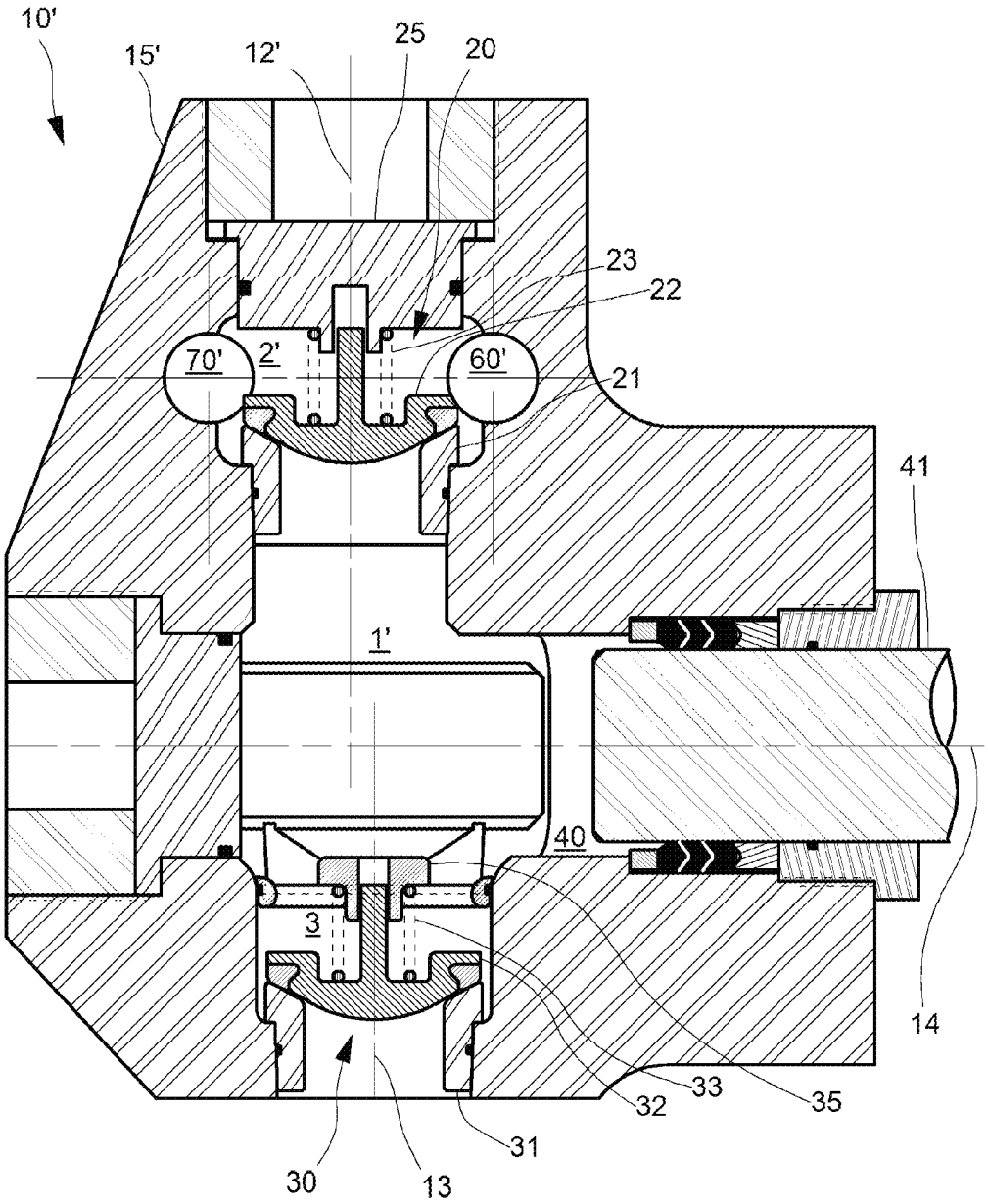
FIG. 13 schematically illustrates an alternate embodiment in which the discharge fluid chamber is offset from the suction fluid chamber.

FIG. 13 schematically illustrates an fourth embodiment of the cross-section of a right-angular plunger pump fluid end 10' of the present invention. Fluid end assembly composes a fluid end housing 15' with a central fluid chamber 1' which has a discharge fluid chamber 2' and a suction chamber 3, wherein discharge fluid chamber 2' contains a discharge valve and seat assembly 20. Said discharge valve and seat assembly includes discharge seat 21, discharge valve 22, discharge spring 23, and discharge cover guide 25. Similarly suction fluid chamber 3 contains a suction valve and seat assembly 30 composed of suction seat 31, suction valve 32, suction spring 33, and suction spring retainer guide 35. Central fluid chamber 1 also contains a plunger bore 40 and associated plunger 41; plunger bore 40 and plunger 41 are concentric to plunger centerline 14.

Discharge fluid chamber 2' illustrated in FIG. 13 is connected to adjacent discharge fluid chambers 102', 202' (not shown) and any additional fluid chambers by dual port discharge manifolds 60' and 70' spaced on opposite sides of fluid chamber 2'. Discharge manifold 60' is proximal to the pump power end and discharge manifold 70' is distal to the pump power end. Centerlines of dual port discharge manifolds 60' and 70' are perpendicular to the axis of plunger bore 40 and parallel to the plane formed by the centerlines 14, 114, and 214 of the plunger bores 40, 140, 240, and any additional plunger bores respectfully in fluid end 10'. Discharge fluid chamber 2', discharge valve and seat assembly 20, and discharge chamber centerline 12' is offset from suction chamber 3 and suction chamber centerline 13; said offset in a direction distal from the pump power end. Discharge chamber centerline 12' is coplanar with suction chamber centerline 13 of the first embodiment, said plane being defined by suction chamber centerline 13 and plunger bore centerline 14.

Although the present invention has been described in detail, it should be understood that various changes, substitutions and alterations can be made hereto without departing from the spirit and scope of the invention as defined by the appended claims.

What is claimed is:

1. A positive displacement pump fluid end, comprising:

a plurality of fluid chambers, each individual fluid chamber in said plurality of fluid chambers further comprising:

a discharge fluid chamber;

a plunger bore;

a discharge valve seat;

a discharge valve;

first and second discharge manifold ports on opposite sides of said each respective individual fluid chamber; and first and second discharge manifolds in fluid communication with said first and second individual discharge manifold ports, respectively, to receive fluid discharged therefrom;

wherein: fluid is discharged through each respective discharge valve and seat by the forward stroke of a plunger in each respective plunger bore, and the flow of said discharged fluid is diverted around each respective discharge valve in a balanced flow pattern above said respective discharge valve to exit said fluid end through said respective first and second discharge manifold ports.

2. The pump fluid end of claim 1, wherein said first and second discharge manifold ports are perpendicular to a plane formed by the centerlines of the plunger bore and discharge fluid chamber.

3. The pump fluid end of claim 1, wherein said discharge manifold ports are spaced apart on opposite sides of the respective discharge fluid chamber.

4. The pump fluid end of claim 1, wherein said discharge manifold ports are blind ports and each port exits the fluid end from opposite sides of the fluid end.

5. The pump fluid end of claim 1, wherein said discharge manifold ports are through ports and both ports exits the fluid end from both sides of the fluid end.

6. The pump fluid end of claim 1, wherein said discharge manifold ports are blind ports and each port exits the fluid end from same side of the fluid end.

7. The pump fluid end of claim 1, wherein said discharge manifold ports have an exit from the fluid end housing with a threaded connection.

8. The pump fluid end of claim 1, wherein said discharge manifold ports have an exit from the fluid end housing with a bolted flange connection.

9. A positive displacement pump fluid end, comprising:

a plurality of fluid chambers, each individual fluid chamber in said plurality of fluid chambers further comprising:

a discharge fluid chamber;

a plunger bore;

a discharge valve seat;

a discharge valve;

a suction fluid chamber;

first and second discharge manifold ports on opposite sides of said each respective individual fluid chamber; and first and second discharge manifolds in fluid communication with said first and second individual discharge manifold ports, respectively, to receive fluid discharged therefrom;

wherein: the centerline of each of said respective discharge fluid chambers is offset from the corresponding centerline of each of said respective suction fluid chambers; and wherein: fluid is discharged through each respective discharge valve and seat by the forward stroke of a plunger in each respective plunger bore, and the flow of said discharged fluid is diverted around each respective discharge valve in a balanced flow pattern above each said respective discharge valve to exit said fluid end through said respective first and second discharge manifold ports.

10. The pump fluid end of claim 9, wherein said centerline of each respective discharge fluid chamber is in a plane defined by the corresponding respective plunger bore centerline and the corresponding respective suction fluid chamber centerline.

11. The pump fluid end of claim 9, wherein said offset is in a direction away from a power end of said positive displacement pump.

12. The pump fluid end of claim 9, wherein said discharge manifold ports are perpendicular to a plane formed by the centerlines of the plunger bore and discharge fluid chamber.

13. The pump fluid end of claim 9, wherein said discharge manifold ports are spaced apart on opposite sides of the discharge fluid chamber.

14. The pump fluid end of claim 9, wherein said discharge manifold ports are blind ports and each port exits the fluid end from opposite sides of the fluid end.

15. The pump fluid end of claim 9, wherein said discharge manifold ports are through ports and both ports exit the fluid end from both sides of the fluid end.

16. The pump fluid end of claim 9, wherein said discharge manifold ports are blind ports and each port exits the fluid end from the same side of the fluid end.

17. The pump fluid end of claim 9, wherein said discharge manifold ports have an exit from the fluid end housing with a threaded connection.

18. The pump fluid end of claim 9, wherein said discharge manifold ports have an exit from the fluid end housing with a bolted flange connection.

* * * * *